US008585212B2

(12) United States Patent
Huber et al.

(10) Patent No.: US 8,585,212 B2
(45) Date of Patent: Nov. 19, 2013

(54) LIGHTING SYSTEM AND METHOD FOR OPERATING A LIGHTING SYSTEM

(75) Inventors: Andreas Huber, Maisach (DE); Ralf Hying, München (DE); Oskar Schallmoser, Ottobrunn (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 1167 days.

(21) Appl. No.: 12/300,928

(22) PCT Filed: May 2, 2007

(86) PCT No.: PCT/EP2007/054261

§ 371 (c)(1),
(2), (4) Date: Nov. 14, 2008

(87) PCT Pub. No.: WO2007/131878

PCT Pub. Date: Nov. 22, 2007

(65) Prior Publication Data

US 2009/0231552 A1 Sep. 17, 2009

(30) Foreign Application Priority Data

May 16, 2006 (EP) ..... 06010104

(51) Int. Cl.

| | |
|---|---|
| ***G03B 21/20*** | (2006.01) |
| ***H05B 39/02*** | (2006.01) |
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 353/85; 315/209 R; 315/291

(58) Field of Classification Search
USPC ..... 353/85; 315/209 R, 224, 225, 226, 291
See application file for complete search history.

(56) References Cited

U.S. PATENT DOCUMENTS

| | | | |
|---|---|---|---|
| 5,936,599 | A | 8/1999 | Reymond |
| 5,977,753 | A | 11/1999 | Edwards et al. |
| 6,135,604 | A | 10/2000 | Lin |
| 6,369,525 | B1 | 4/2002 | Chang et al. |
| 6,528,954 | B1 | 3/2003 | Lys et al. |

(Continued)

FOREIGN PATENT DOCUMENTS

| | | |
|---|---|---|
| DE | 200 18 865 | 2/2001 |
| JP | 2002-016290 | 1/2002 |

(Continued)

*Primary Examiner* — William C Dowling
*Assistant Examiner* — Ryan Howard
(74) *Attorney, Agent, or Firm* — Cozen O'Connor

(57) ABSTRACT

A lighting system comprising a first light source, which is adapted to generate light of a first color, and at least one second light source, which is adapted to generate light of a second color, wherein the light sources are driven so as to generate a predeterminable color sequence, wherein the light sources are operated by a common control unit and driven by said control unit in the sequence required for generating the predeterminable color sequence. The light sources are connected in parallel and are electrically coupled to an energy supply unit via a first circuit node. The lighting system comprises a regulator unit and coupled to the control unit via a signal line, and wherein the control unit is adapted to predetermine a desired energy output of the energy supply unit via the regulator unit, to be precise depending on the individual color within the color sequence.

9 Claims, 2 Drawing Sheets

(56) References Cited

U.S. PATENT DOCUMENTS

| | | | | |
|---|---|---|---|---|
| 6,618,031 | B1 | 9/2003 | Bohn, Jr. et al. | |
| 6,685,339 | B2 | 2/2004 | Daughtry et al. | |
| 7,038,399 | B2 | 5/2006 | Lys et al. | |
| 2003/0117087 | A1 * | 6/2003 | Barth et al. | 315/291 |
| 2003/0151917 | A1 | 8/2003 | Daughtry et al. | |
| 2004/0036418 | A1 | 2/2004 | Rooke et al. | |
| 2004/0196225 | A1 | 10/2004 | Shimada | |
| 2004/0212321 | A1 | 10/2004 | Lys et al. | |
| 2005/0218838 | A1 | 10/2005 | Lys | |
| 2005/0254018 | A1 * | 11/2005 | Magarill et al. | 353/94 |

FOREIGN PATENT DOCUMENTS

| | | |
|---|---|---|
| JP | 2002-078323 | 3/2002 |
| JP | 2004-311635 | 4/2004 |
| JP | 2005-347133 | 12/2005 |
| WO | WO 01/69980 | 9/2001 |

* cited by examiner

LIGHTING SYSTEM AND METHOD FOR OPERATING A LIGHTING SYSTEM

RELATED APPLICATIONS

This is a U.S. national stage of application No. PCT/EP2007/054261, filed on May 2, 2007.

This application claims the priority of European patent application no. 06010104.5 filed May 16, 2006, the content of which is hereby incorporated by reference.

FIELD OF THE INVENTION

The present invention relates to a lighting system with a first light source, which is designed to generate light signals of a first color, and at least one second light source, which is designed to generate light signals of a second color, the light sources being capable of being driven so as to generate a predeterminable color sequence. The invention also relates to a method for operating such a lighting system.

BACKGROUND OF THE INVENTION

In lighting systems such as image projection systems it is known that a DLP (digital light processing) chip is used for generating image sequences. This DLP chip can, however, only generate grayscale images. In order to be able to achieve a colored representation it is necessary that the light source used of the image projection system generates differently colored light in quick succession. If the light source is designed as an HID (high intensity discharge) lamp and is intended to generate white light, it is necessary that a so-called color wheel is used for generating the differently colored light. This color wheel comprises a plurality of transparent color filters which generate the desired color sequence by rotation of the color wheel. In this case a color sequence is understood to mean the temporal and/or spatial change of a color reproduction or color succession represented on a projection area. For example, this color sequence can take place in the case of an image projection system on a display, for example an LCD (liquid crystal display) or a DLP display. The display of such a color sequence can, however, also take place on another projection area or another display.

In order to obtain such a color sequence even with light emitting diodes which are each designed to generate light signals of an individual color, these light emitting diodes are switched on and off sequentially. For this purpose, each light emitting diode is operated via a dedicated separate control unit. The known procedures and configurations are relatively complex in design and cannot in all cases make sufficient representation of the desired color sequence possible.

SUMMARY OF THE INVENTION

One object of the invention is to provide a lighting system and a method for operating the lighting system with which the representation of color sequences can be improved.

One aspect of the present invention is directed to a lighting system comprising a first light source, which is designed to generate light signals of a first color, and at least one second light source, which is designed to generate light signals of a second color. The light sources are capable of being driven so as to generate a predeterminable color sequence. The light sources of the lighting system, in particular all of the light sources, are capable of being operated by a common single control unit and are capable of being driven by said one control unit in the manner required for generating the predeterminable color sequence, in particular in the required order. As a result, a lighting system can be provided which makes possible optimal driving of a plurality of light sources with a view to the generation of a desired color sequence with reduced complexity. As a result, the lighting system can have a more compact and cost-effective design. By virtue of the fact that all of the light sources are capable of being driven individually by a common control unit, the accuracy of the luminous intensity generated in terms of its profile over time and therefore also the image quality can also be improved and complex color sequences can be generated precisely.

Preferably, the light sources are connected in parallel and are electrically connected to an energy supply unit, in particular a current source, via a first circuit node in order to supply energy. Preferably, the current source is designed to provide at least an electrical current with a dominant DC component or to provide a direct current.

Preferably, the lighting system also comprises a regulator unit for regulating the energy supply unit, which regulator unit is connected to the control unit. The control unit is preferably designed to predetermine a desired energy output of the energy supply unit, in particular of the current source, and a switching frequency at which the energy supply unit is switched on and off, these two predetermined parameters being capable of being transmitted to the regulator unit. If the energy supply unit is designed as a current source, the latter is preferably configured as a step-down converter or as a buck converter without a filter capacitor. Thus, a rapid change from one individual color to the next within a color sequence is possible.

In order that radiofrequency voltage fluctuations at the output of the energy supply unit are damped, a filter capacitor can be connected in parallel with the output of the energy supply unit. This measure suppresses radio interference. However, a filter capacitor prevents rapid commutation of the current supplied by the energy supply unit. When using the lighting system in image projection systems as described above, however, a high-contrast color sequence is often required. Tests have shown that the following rules apply for the dimensioning of the filter capacitor:

Initially, a maximum current Imax is defined by the current output by the energy supply unit (1) if the lighting system generates a maximum luminous intensity specified for the lighting system. This maximum current Imax fixes an upper limit value for the filter capacitor. The capacitance value of the filter capacitor, measured in microfarads, must be lower than the value of the maximum current, measured in amperes.

The light sources of the lighting system are preferably each connected into signal paths which are connected in parallel with one another, at least one light source in the corresponding signal path being connected in series with a switch, and the switches being capable of being driven by means of the control unit so as to open or close. It can also be provided that in the case of a plurality N of light sources of the lighting system, a number N−1 is in each case connected in series with an associated switch in the corresponding signal path. Only one of the light sources is not connected in series with a switch. In the case of such an embodiment, the light source which is not connected in series with a switch has the greatest forward voltage in comparison with the other light sources of the lighting system. In a configuration in which only a number N−1 of light sources is in each case connected in series with a switch, the light source which is not connected in series with a switch is therefore preferably that with the highest characteristic working voltage. With such a configuration, safe operation of the light sources with few components can be made possible and only one control unit and a switch with a simple design, in particular a semiconductor switch, is required, as a result of which the entire system can have a more cost-effective and also space-optimized design.

Preferably, the operating states of the individual light sources are capable of being predetermined depending on the settings of the switches.

Preferably, these switches are connected to a second circuit node. The lighting system or the circuit arrangement comprising the plurality of light sources which represent loads are therefore all connected to a first common circuit node, via which an energy supply, in particular a current supply, can be provided, with in turn switches, which are connected in series thereto, being connected to the second circuit node, by means of which it is possible for the energy, in particular the electrical current, to be fed back to the energy supply unit, in particular the current source. The individual switches, which can be referred to as current valves, in particular in the case of an energy supply via a current source, can be opened and closed via the control unit in such a way that safe and fault-free switching can be made possible although every single one of the current valves or every single switch is in series, via the load associated with it or the light source associated with it, with this energy supply unit or the current source, respectively.

Preferably, at least one capacitor or a load-relieving capacitor for the controllable switches is connected between the two circuit nodes. It can also be provided that such a capacitor is connected in parallel with each switch. It can preferably be provided that all of the connecting nodes between the light sources and the associated switches are connected by a symmetrical or asymmetrical network of such capacitors.

Preferably, apart from relatively short commutation intervals, always at least one of said current valves or one of the switches is constantly switched so as to be conductive and therefore closed.

Preferably, as a result of a reduced output current of the energy supply unit, in particular the current source, during this commutation time the voltage across all of the switches switched in a block mode is below its critical threshold. Preferably, the output current is capable of being set by the regulator unit, the regulator unit advantageously having feed-forward control.

The power requirement to the common energy supply unit can change between the individual operating states of the light sources, which can change depending on the color sequence to be generated in situation-dependent fashion.

In the case of simultaneous operation of a plurality of the light sources it can be provided that the regulator unit adjusts the energy supply unit, in particular the current source, to the extent that precisely that power is output which is required by the totality of the light sources. It can be provided that the regulator unit is preventively set, during the short commutation intervals, to the power requirement to be expected in the subsequent operating state, preferably in such a way that the transient recovery time of the entire system is thereby shortened. It can likewise be provided that the regulator unit is designed in such a way that it reduces the transient recovery amplitude of the system directly after the commutation intervals by dynamic setpoint value setting.

Preferably, at least one light source is designed as a light emitting diode. It is preferably provided that all of the light sources of the lighting system are designed as light emitting diodes, each of the light emitting diodes being designed to generate light signals of an individual color. It can also be provided that at least two of such light emitting diodes are connected in series in a signal path, and both are designed to generate light signals of one light color. As a result, chains of light emitting diodes can be formed, with each chain in itself being monochrome.

It can also be provided that the radiant intensity of the light emitting diodes is an input variable for the regulator unit.

Preferably, the lighting system is designed as an image projection system, the light sources then being arranged in such a way that they are arranged for illuminating an image display apparatus, in particular a display.

In the case of a method according to an aspect of the invention for operating a lighting system with a first light source and at least one second light source, which are designed to generate light signals of different colors, the light sources are driven correspondingly so as to generate a predeterminable color sequence. The light sources are operated by a common control unit and are driven by this control unit in the succession required for generating the predeterminable color sequence, in particular in the required order. Such a method makes it possible to generate even very complex color sequences in a manner which involves little complexity and is nevertheless precise.

BRIEF DESCRIPTION OF THE DRAWINGS

Two exemplary embodiments of the present invention will be explained in more detail below using schematic drawings.

DETAILED DESCRIPTION OF THE DRAWINGS

Figure 1:
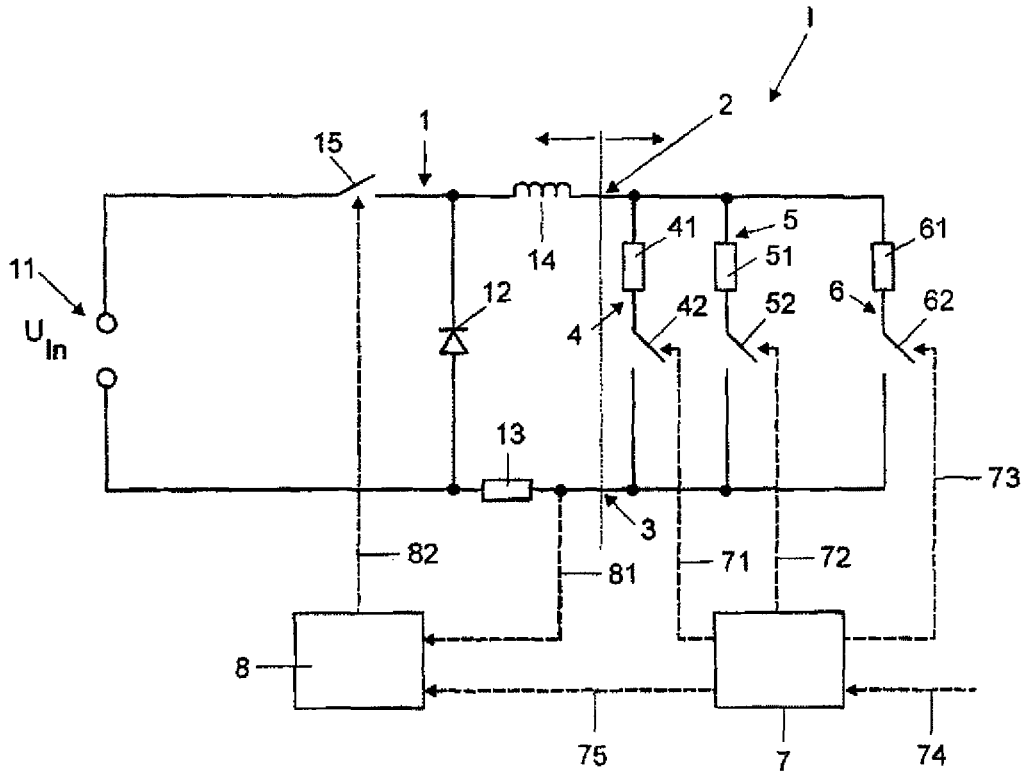
FIGS. 1 and 2 show circuit arrangements of an image projection system.

The schematic illustration shown in FIG. 1 shows a circuit arrangement of a lighting system which is designed as an image projection system I. The image projection system I comprises, as energy supply unit, a current source 1, which has a voltage source 11 and a diode 12, a shunt 13 and an inductance 14'. Furthermore, the current source 1 comprises a switch 15. The circuit arrangement illustrated of the image projection system T comprises a first circuit node 2 and a second circuit node 3. Furthermore, the image projection system I comprises an image display apparatus (not illustrated), which is capable of being illuminated via a plurality of light sources for representing a color sequence.

For this purpose, the lighting system or the image projection system I in the exemplary embodiment has a plurality of light sources 41, 51 and 61 connected in parallel. The light sources 41, 51 and 61, which are designed as loads, are realized in the exemplary embodiment as light emitting diodes, the light source 41 being designed to generate light signals of the light color green, the second light source 51 being designed to generate light signals of the light color red, and the third light source 61 being designed to generate light signals of the light color blue.

As can be seen from the illustration in FIG. 1, the first light source 41 is connected into a signal path 4, in which a switch 42 is connected in series with the light source 41. Correspondingly, the second light source 51 is connected in a parallel signal path 5, the second light source 51 being connected in series with a second switch 52. Similarly to this, the third light source 61 is connected in series with a switch 62 in a third signal path 6. The three signal paths 4, 5 and 6 are connected in parallel with one another, the light sources 41, 51 and 61 being connected to the first circuit node 2 for the supply of energy by the current source 1.

The three switches 42, 52 and 62 are connected to the second circuit node 3 for the feedback of the current to the current source 1.

Furthermore, the circuit arrangement shown or the image projection system I comprises a control unit 7, which is designed to control all three switches 42, 52 and 62 and therefore also to control the operating state of the light sources 41, 51 and 61. The switches 42, 52 and 62 are in this case opened and closed by the control unit 7 in such a way that the light sources 41, 51 and 61 required for generating the predeterminable color sequence are operated in situation-dependent fashion. For this purpose, the one common control unit 7 makes contact with the respective switches 42, 52 and 62 via separate signal links 71, 72 and 73.

As is furthermore shown in FIG. 1, a further signal link 74 is formed which represents an interface for the synchronization of the microprocessor or the control unit 7 with further components of the image projection system I.

With a view to the situation-dependent provision of energy by the current source 1 which is required, the image projection system I in the circuit arrangement shown also comprises a regulator unit 8, which is electrically connected to the control unit 7, it being possible, for this purpose, for a setpoint-value predetermination and the predetermination of a switching frequency to be transmitted by the control unit 7 to the regulator unit 8 via a signal link 75. Depending on these predeterminable parameters, the regulator unit 8 can regulate the switch 15 of the current source 1 correspondingly via a signal link 82. Furthermore, a current measurement can take place via a signal link 81, which current measurement can be provided as information to the regulator unit 8. Depending on these predeterminations and this information, the provision of energy by the current source 1 can then be regulated in situation-dependent fashion by means of the regulator unit 8, and an individually required energy output, in particular an individual and situation-dependent supply of current to the light sources 41, 51 and 61, can be ensured.

Depending on the instantaneously required luminous intensity and light composition, at least one of the light sources 41, 51 and 61 can then be operated by virtue of the corresponding switches 42, 52 and 62 being opened or closed via the common control unit 7. As a result, the representation of a very wide variety of color sequences can be made possible in a manner involving less complexity and fewer components by means of the image projection system I. The order of the light sources 41, 51 and 61 to be operated which is required for this purpose can be implemented by a single operating device or by a single control unit 7.

Figure 2:
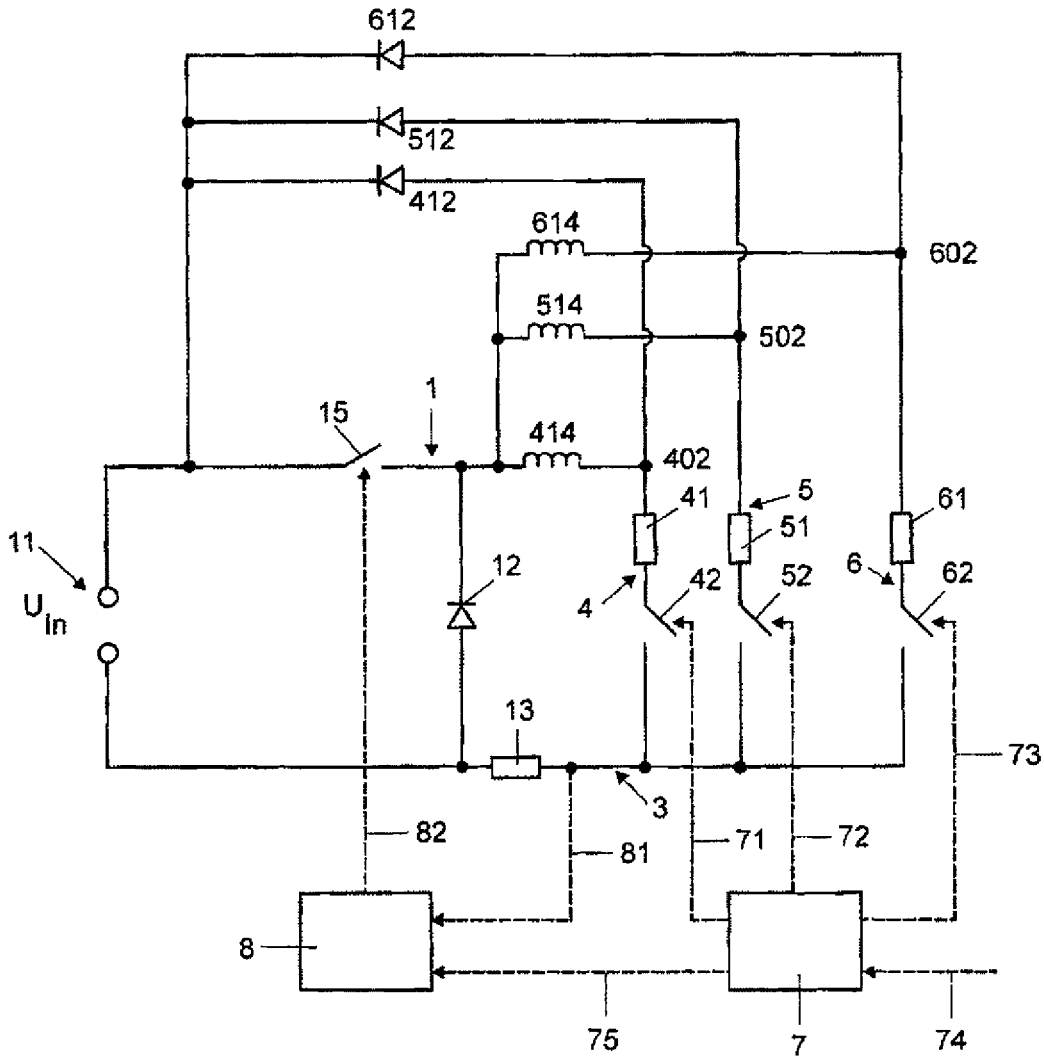

FIG. 2 illustrates a circuit arrangement of a lighting system with which simultaneous operation of two or more light sources 41, 51, 61 with freely selectable rms currents is possible. The circuit arrangement shown in FIG. 1 does not provide this option.

In contrast to FIG. 1, the energy supply unit 1 now has in each case one inductor 414, 514, 614 for each light source 41, 51, 61. Each light source 41, 51, 61 is connected to the respective inductor 414, 514, 614 via in each case one dedicated output node 402, 502, 602. As in FIG. 1, the energy supply unit 1 has an input terminal 11, at which a voltage source can be fed in with respect to a reference potential. In each case one freewheeling diode 412, 512, 612 is connected between the output nodes 402, 502, 602 and the input terminal 11.

The switches 42, 52, 62 can now be driven by in each case one PWM signal by means of the control unit 7. Corresponding to a duty factor of the respective PWM signal, the rms current of the respective light source 41, 51, 61 can be set. The regulator unit 8 sets the maximum possible current via the switch 15.

Advantageously, the switching operations of the switches 42, 52 and 62 can be synchronized with the switching of the switch 15. If the switches 42, 52 and 62 are only opened when the switch 15 is also open, the demagnetization current flowing via the diodes 412, 512 and 612 works counter to the input voltage at the input terminal 11. As a result, the inductors 414, 514 and 614 are demagnetized more quickly and the light sources 41, 51 and 61 can be switched off more quickly.

The invention claimed is:

1. A lighting system comprising:

a first light source configured to generate light signals of a first color; and at least one second light source configured to generate light signals of a second color;

wherein the first and second light sources are configured to be driven so as to generate a predeterminable color sequence of individual colors;

wherein the first and second light sources are configured to be operated by a common control unit and to be driven by said common control unit in a sequence required for generating the predeterminable color sequence;

wherein the light sources are connected in parallel and are electrically coupled to an energy supply unit via a first circuit node in order to supply energy;

wherein the lighting system comprises a regulator unit for regulating the energy supply unit and coupled to the control unit via a signal line;

wherein the control unit is configured to predetermine a desired energy output of the energy supply unit via the regulator unit depending on an individual color within the color sequence;

wherein the lighting system comprises a number N of light sources, at least a number N−1 of light sources each being connected in series with a respective switch in a signal path, each respective switch being drivable by the control unit; and wherein the energy supply unit is a step-down converter or a buck converter, the energy supply unit has one inductor for each light source, each light source is connected to a respective inductor via each output node, the energy supply unit has an input terminal at which a voltage source with respect to a reference potential can be fed in, and one freewheeling diode is connected between each output node and the input terminal.

2. The lighting system as claimed in claim 1, wherein the control unit is further configured to predetermine a switching frequency of the energy supply unit for the regulator unit.

3. The lighting system as claimed in claim 1, wherein each respective switch is connected to a second circuit node, and a filter capacitor is connected between a first and the second circuit node.

4. The lighting system as claimed in claim 3, wherein a maximum current is defined by a current output by the energy supply unit if all switches are closed and the lighting system generates a maximum luminous intensity specified for the lighting system; and wherein a non-zero capacitance value of the filter capacitor, measured in microfarads, is lower than a value of the maximum current, measured in amperes.

5. The lighting system as claimed in claim 1, wherein the energy supply unit is without an output filter capacitor.

6. The lighting system as claimed in claim 1, wherein all connecting nodes between the light sources and each respective switch are connected by a symmetrical or asymmetrical network of capacitors.

7. The lighting system as claimed in claim 1, wherein during simultaneous operation of two or more light sources, freely selectable rms currents are settable in the simultaneously operated light sources by the control unit configured so that each respective switch is drivable by one pulse width modulation (PWM) signal.

8. The lighting system as claimed in claim 1, wherein at least one light source is a light emitting diode.

9. The lighting system as claimed in claim 1, wherein the lighting system is an image projection system.

* * * * *